US012565731B2

(12) United States Patent
Froelicher et al.

(10) Patent No.: US 12,565,731 B2
(45) Date of Patent: Mar. 3, 2026

(54) LAUNDRY MACHINE WITH BOTTOM BALANCE RING ASSEMBLY

(71) Applicant: Haier US Appliance Solutions, Inc., Wilmington, DE (US)

(72) Inventors: Stephen Bernard Froelicher, Shepherdsville, KY (US); Cody Ewing, Floyds Knobs, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 224 days.

(21) Appl. No.: 18/357,437

(22) Filed: Jul. 24, 2023

(65) Prior Publication Data

US 2025/0034785 A1 Jan. 30, 2025

(51) Int. Cl.

| | |
|---|---|
| ***D06F 37/24*** | (2006.01) |
| *D06F 23/04* | (2006.01) |
| *D06F 37/12* | (2006.01) |

(52) U.S. Cl.

CPC ..... *D06F 37/245* (2013.01); *D06F 37/24* (2013.01); *D06F 23/04* (2013.01); *D06F 37/12* (2013.01)

(58) Field of Classification Search

CPC ..... D06F 37/24; D06F 37/245

See application file for complete search history.

(56) References Cited

U.S. PATENT DOCUMENTS

| | | | | |
|---|---|---|---|---|
| 4,044,626 A | | 8/1977 | Hayashi et al. | |
| 5,724,862 A | * | 3/1998 | Hannah | G01M 1/36 74/570.2 |
| 5,761,933 A | * | 6/1998 | Kim | D06F 37/245 74/572.4 |
| 5,870,908 A | | 2/1999 | Rushlow | |
| 2011/0162442 A1 | * | 7/2011 | Ronlan | D06F 37/24 73/66 |
| 2013/0227994 A1 | * | 9/2013 | Naber | D06F 37/12 68/13 R |

FOREIGN PATENT DOCUMENTS

| | | | | |
|---|---|---|---|---|
| CA | 2646745 C | | 11/2013 | |
| CN | 1331358 A | * | 1/2002 | D06F 37/245 |
| CN | 102587084 A | * | 7/2012 | D06F 39/14 |
| WO | WO1999050495 A1 | | 10/1999 | |

OTHER PUBLICATIONS

Machine translation of CN 102587084 A to Da Riol et al. (Year: 2012).*

Machine translation of CN 1331358 A to Gaster et al. (Year: 2002).*

Marsh et al., "Developing An Understanding Of Washing Machines Dynamics", 2006 MISG, pp. 133-152.

Urbiola-Soto et al., "Dynamic Performance of the LeBlanc Balancer for Automatic Washing Machines", Journal of Vibration and Acoustics, vol. 133, Aug. 2011, pp. 041014-1-041014-8.

* cited by examiner

*Primary Examiner* — Joseph L. Perrin

(74) *Attorney, Agent, or Firm* — Dority & Manning, P.A.

(57) ABSTRACT

A laundry machine appliance is provided, including a cabinet forming an interior volume, a tub positioned within the interior volume, and a wash basket rotatably mounted within the tub and forming a wash chamber. A balance ring assembly is positioned at a base of the wash basket. The balance ring assembly forms a sealed passage between a base wall, a sidewall, and a top wall. The sealed passage extends circumferentially along the wash basket. The balance ring assembly includes a balance member forming a puck positioned at the sealed passage.

16 Claims, 10 Drawing Sheets

LAUNDRY MACHINE WITH BOTTOM BALANCE RING ASSEMBLY

FIELD OF THE INVENTION

The present subject matter relates generally to laundry machine apparatuses.

BACKGROUND OF THE INVENTION

Conventional laundry machines, such as washing machines, are configured to perform a spin cycle at which a wash basket rotates at high speed. To facilitate high speed spin, a balance ring is installed at the wash basket. Balance rings are typically positioned at the top of the wash basket, which facilitates installation to the wash basket. However, bottom balance rings generally provide better performance that top balance rings, such as improved noise and vibration, and decreased wear of other laundry machine components, such as the damping and suspension system.

However, bottom balance rings may generally be more difficult to install, which may increase the cost of a washing machine including bottom balance ring over a washing machine with a top balance ring. While bottom balance rings generally offer better performance than top balance rings, bottom balance rings being obscured by other structures of the laundry machine may obscure the benefits associated with bottom balance rings.

Accordingly, a laundry machine including features addressing the aforementioned issues would be beneficial and advantageous.

BRIEF DESCRIPTION OF THE INVENTION

Aspects and advantages of the invention will be set forth in part in the following description, or may be obvious from the description, or may be learned through practice of the invention.

An aspect of the present disclosure is directed to a laundry machine appliance, including a cabinet forming an interior volume, a tub positioned within the interior volume, a wash basket rotatably mounted within the tub, the wash basket including a cylindrical wall forming a wash chamber extending along a vertical direction and a base positioned at a bottom of the cylindrical wall. A balance ring assembly is positioned at the base of the wash basket, the balance ring assembly forming a sealed passage between a base wall, a sidewall, and a top wall. The sealed passage extends circumferentially along the wash basket. The balance ring assembly includes a balance member forming a puck positioned at the sealed passage.

An aspect of the present disclosure is directed to a top load washing machine appliance, including a cabinet forming an interior volume, a tub positioned within the interior volume, a wash basket rotatably mounted within the tub, the wash basket including a cylindrical wall forming a wash chamber extending along a vertical direction and a base positioned at a bottom of the cylindrical wall. A balance ring assembly is positioned at the base of the wash basket, the balance ring assembly forming a sealed passage between a base wall, a sidewall, and a top wall. The sealed passage extends circumferentially along the wash basket. The balance ring assembly includes a balance member positioned at the sealed passage. The balance member forming a puck including a central axis configured to extend through the base wall and move through the passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
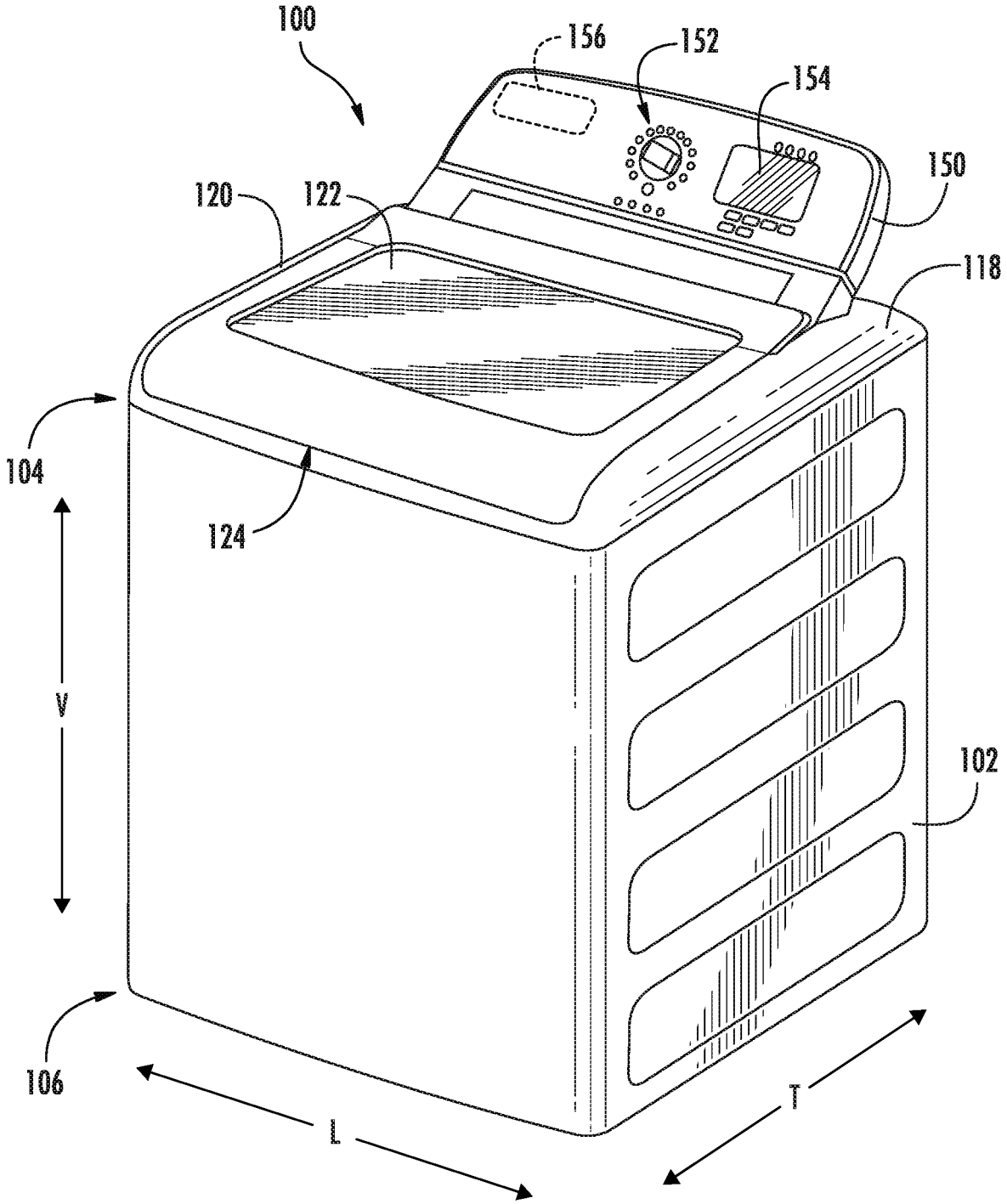
FIG. 1 provides a perspective view of a laundry machine appliance with a lid in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
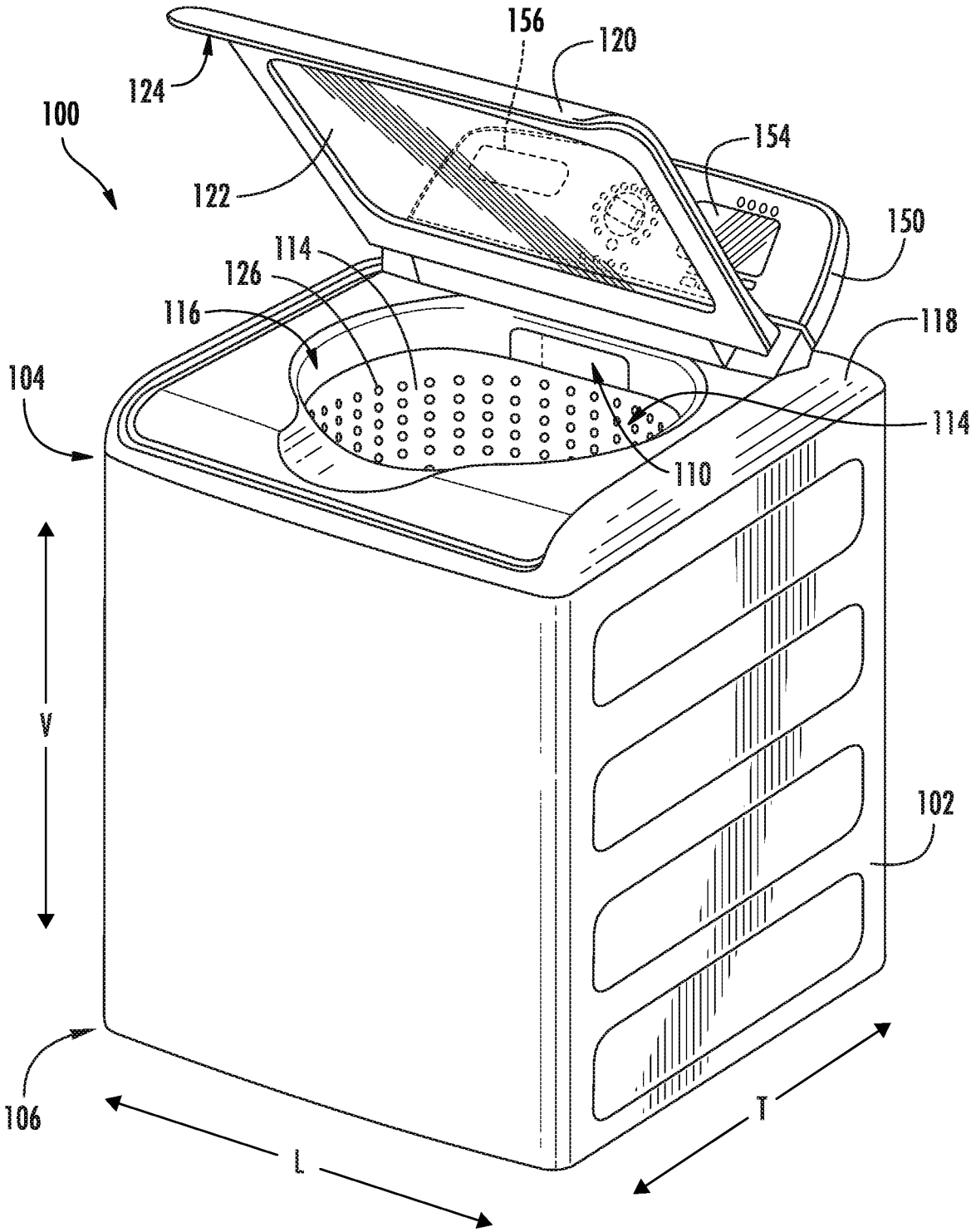
FIG. 2 provides a perspective view of the exemplary laundry machine appliance of FIG. 1 with the lid in an open position.
Figure 3:
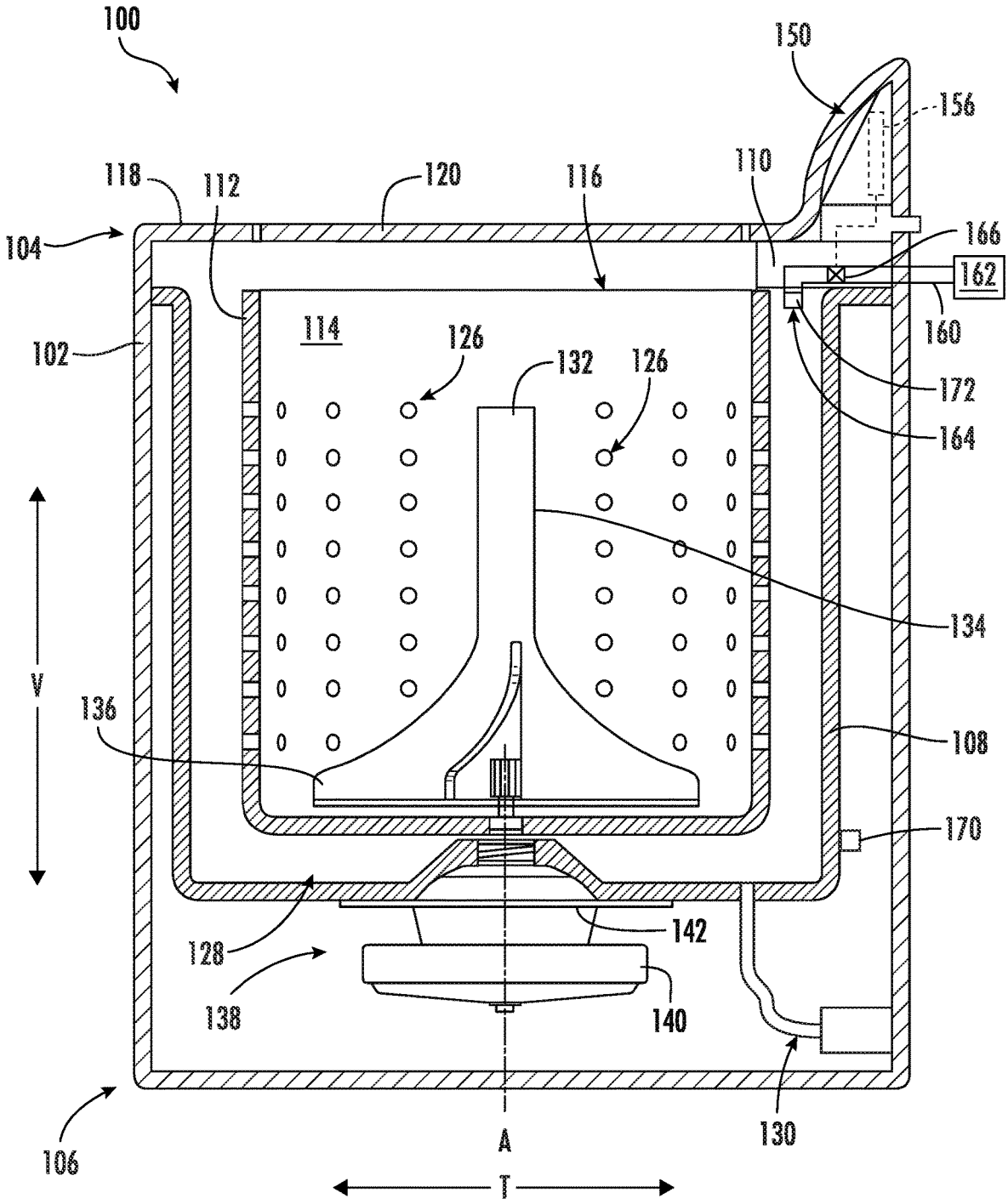
FIG. 3 provides a cut-away side view of the exemplary laundry machine appliance of FIG. 1.

FIGS. 1 through 3 illustrate an exemplary embodiment of a vertical axis laundry machine appliance or washing machine 100. Specifically, FIGS. 1 and 2 illustrate perspective views of laundry machine appliance 100 in a closed and an open position, respectively. FIG. 3 provides a side cross-sectional view of laundry machine appliance 100. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Indeed, modifications and variations may be made to laundry machine appliance 100, including different configurations, different appearances, and/or different features while remaining within the scope of the present subject matter. For instance, laundry machine appliance 100 may be a combination washing machine and dryer appliance.

Laundry machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle (e.g., a washing cycle). Laundry machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments.

In addition, laundry machine appliance 100 includes a drum or wash basket 112 that is positioned within tub 108 and generally defines a wash chamber 114 including an opening 116 for receipt of articles for washing. More specifically, wash basket 112 may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well.

As illustrated, cabinet 102 of laundry machine appliance 100 has a top panel 118. Top panel 118 defines an opening (FIG. 2) that coincides with opening 116 of wash basket 112 to permit a user access to wash basket 112. Laundry machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of laundry machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. Perforations 126 extend through a cylindrical wall 214 forming, at least in part, the wash basket 112. The cylindrical wall 214 extends from a bottom base 212, at which a balance ring assembly 200 is positioned, such as further described herein.

Wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Laundry machine appliance 100 may further include a pump assembly 130 (FIG. 3) that is located beneath tub 108 and wash basket 112 for gravity assisted flow when draining tub 108, e.g., after a wash or rinse cycle.

In some embodiments, an impeller or agitator 132 (FIG. 3), such as a vane agitator, impeller, auger, oscillatory basket mechanism, or some combination thereof may extend from base 212 to impart an oscillatory motion to articles and liquid in wash basket 112. More specifically, agitator 132 may include a shaft 134 extending along the vertical axis V and an oscillatory member 136 extending from the shaft 134. The agitator 132 may extend into wash basket and assists agitation of articles disposed within wash basket 112 during operation of laundry machine appliance 100. e.g., to facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitator 132 and wash basket 112 are oriented to rotate about the axis of rotation A (which is substantially parallel to vertical direction V). The agitator shown in FIG. 3 (agitator 132) is merely an example, and any suitable agitator may be incorporated.

As best illustrated in FIG. 3, laundry machine appliance 100 includes a drive assembly 138 in mechanical communication with wash basket 112 to selectively rotate wash basket 112 (e.g., during an agitation or a rinse cycle of laundry machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of laundry machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring to FIGS. 1-3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of laundry machine appliance 100 is controlled by a controller or processing device 156 that is communicatively coupled with control panel 150 for user manipulation to select washing machine cycles and features. In response to user manipulation of control panel 150, controller 156 operates the various components of laundry machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of laundry machine appliance 100 may be in communication with controller 156 via one or more signal lines or shared communication busses.

Referring to FIG. 3, laundry machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, laundry machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108. Laundry appliance 100 may include a flow meter 172. Flow meter 172 may be connected to water supply conduit 160 to measure an amount of water added to tub 108. Flow meter 172 may send the detected water flow amount to controller 156. In addition, laundry machine appliance 100 may include one or more pressure sensors 170 for detecting the amount of water and or clothes within tub 108. For example, pressure sensor 170 may be operably coupled to a side of tub 108 for detecting the weight of tub 108. Additionally or alternatively, pressure sensor 170 may detect and/or calculate a pressure of water within tub 108.

Referring now to FIGS. 4-11, embodiments of a bottom-positioned balance ring assembly 200 are provided. Embodiments of the balance ring assembly 200 are positioned at the base 212 of the wash basket 112. The balance ring assembly 200 includes a balance member passage 218 formed between a base wall 220, sidewalls 224, and a top wall 222. A balance member 210 is positioned in the passage 218 extending circumferentially along the base 212 of the wash basket 112. The balance member 210 is allowed to move freely through the passage 218, such as to provide rotational balance, or prevent unbalance, at the wash basket 112.

In various embodiments, the base wall 220, the sidewalls 224, and the top wall 222 form a sealed passage 218. For instance, such as depicted in detail at FIG. 7, a liquid fluid 230, such as, but not limited to, water, a water-based solution, a lubricant, or an oil-based solution, is contained within the passage 218 and fluidly segregated from fluid at the wash chamber 114 during the wash cycle. In still some instances, the fluid 230 may include a colorant, such as a dye, or a fluorescent fluid.

Figure 6:
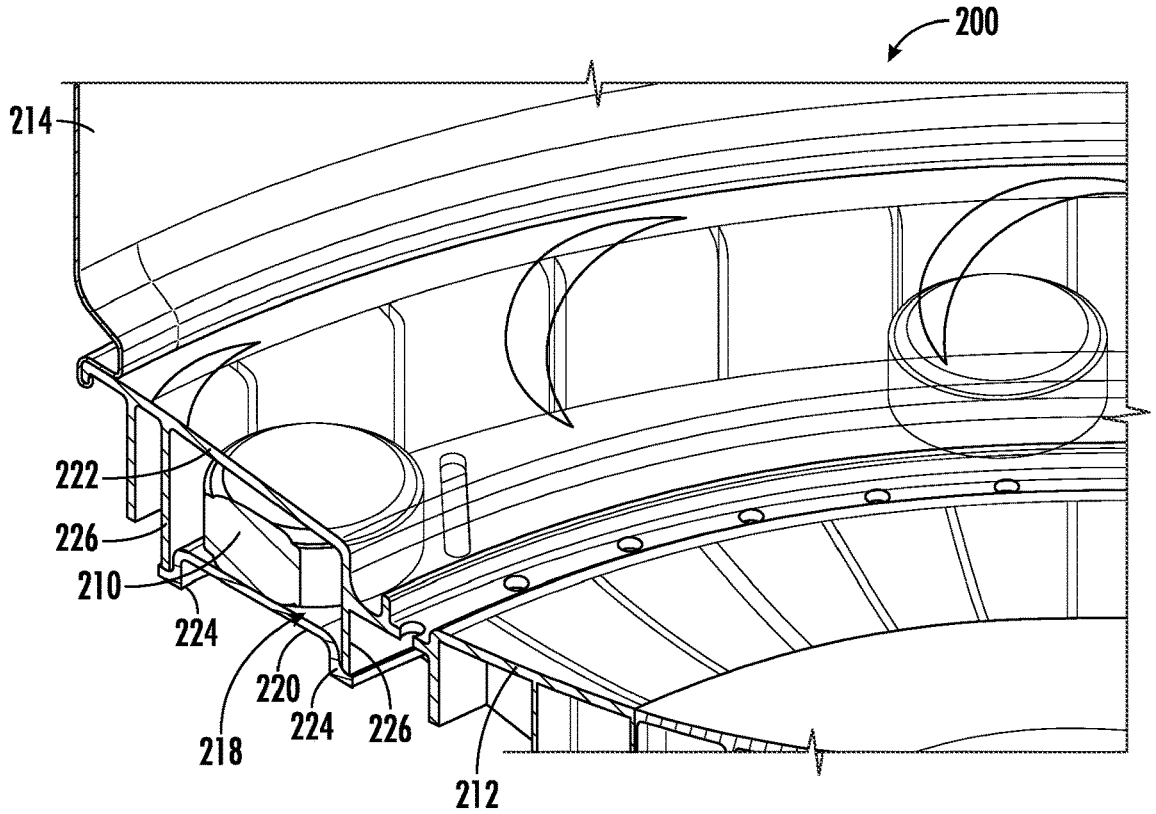
FIG. 6 provides a cut-away perspective view of an exemplary embodiment of a bottom-positioned balance ring assembly for the laundry machine appliance in accordance with aspects of the present disclosure.
Figure 7:
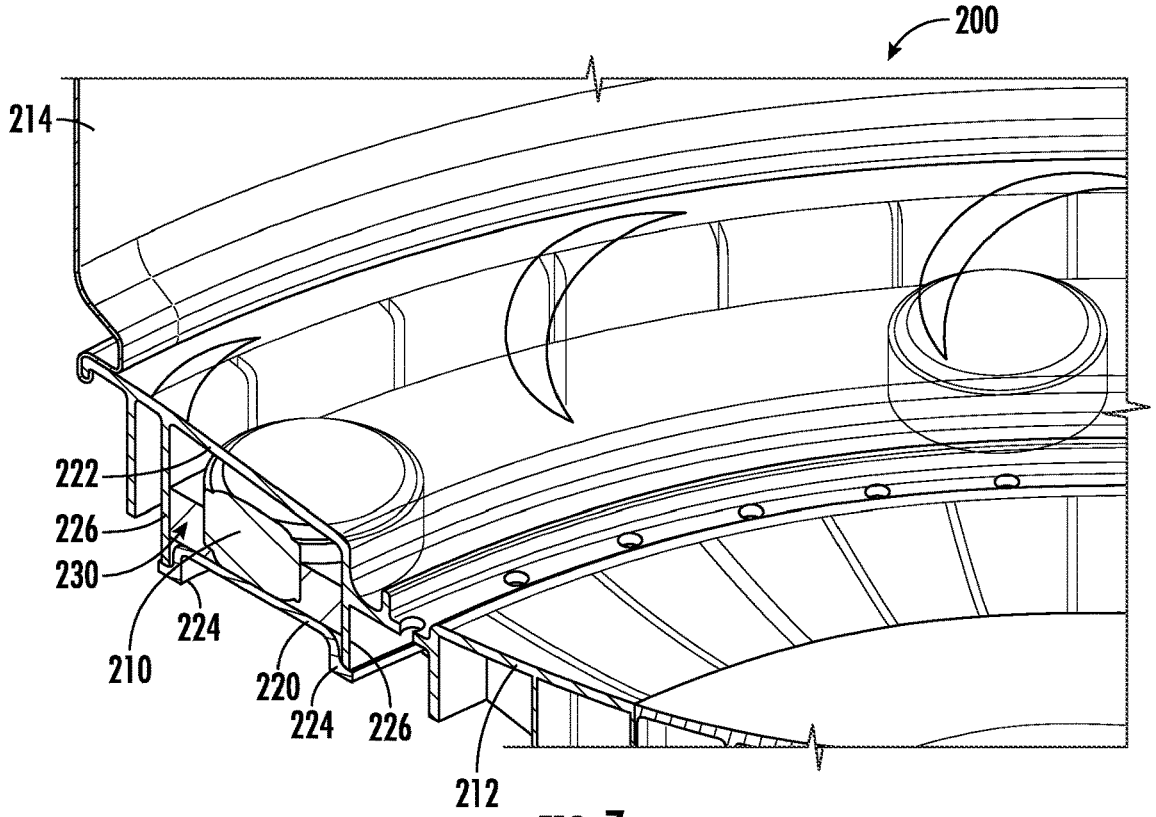
FIG. 7 provides a cut-away perspective view of an exemplary embodiment of a bottom-positioned balance ring assembly for the laundry machine appliance in accordance with aspects of the present disclosure.
Figure 8:
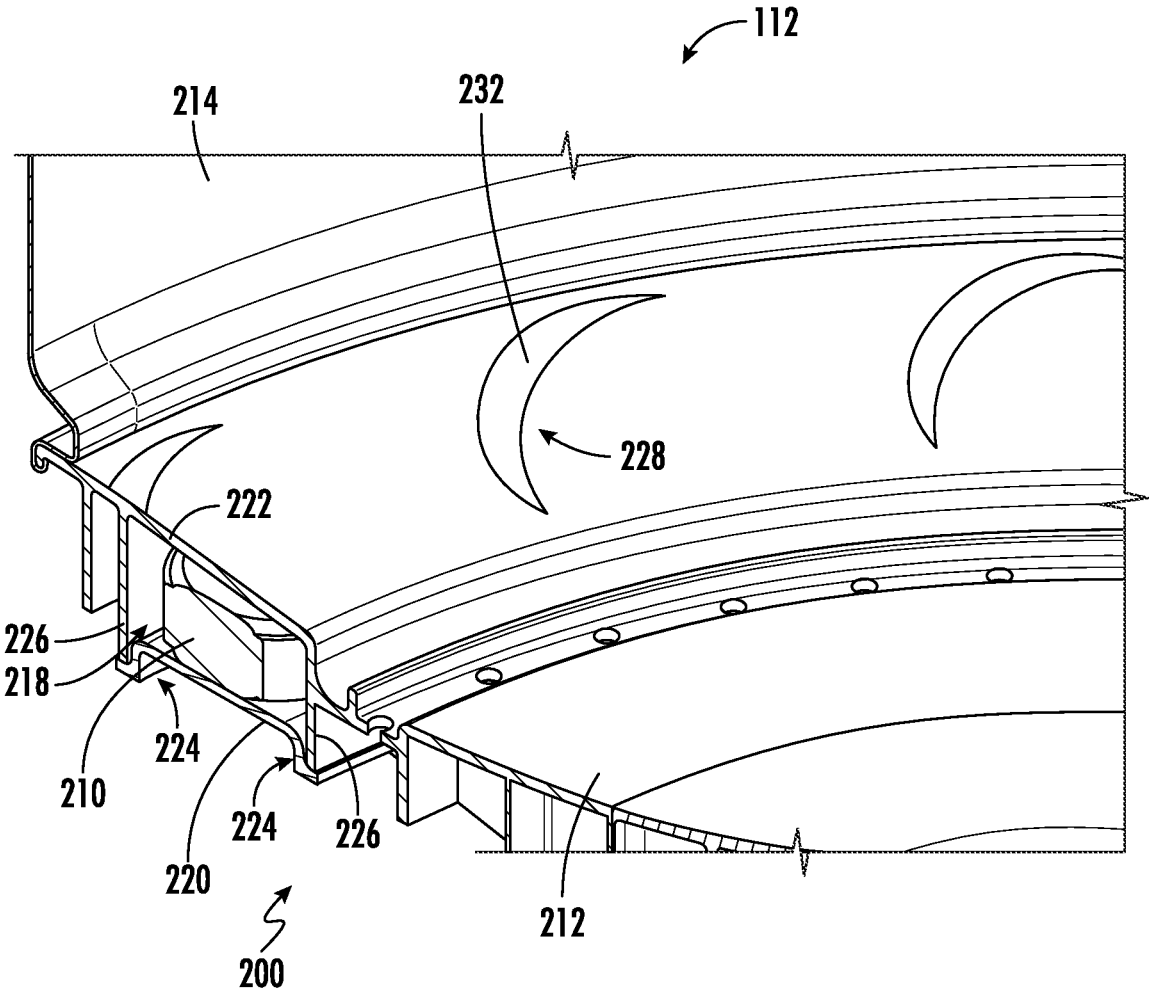
FIG. 8 provides a cut-away perspective view of an exemplary embodiment of a bottom-positioned balance ring assembly for the laundry machine appliance in accordance with aspects of the present disclosure.
Figure 9:
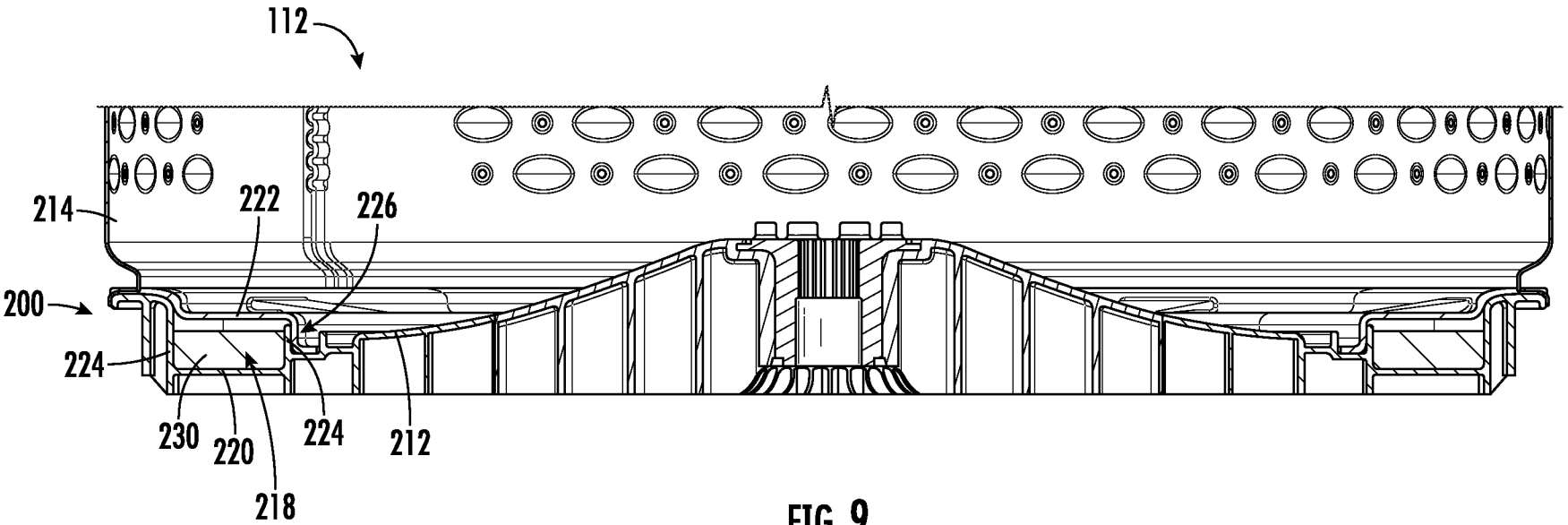
FIG. 9 provides a cut-away side view of an exemplary embodiment of a wash basket for the laundry machine appliance in accordance with aspects of the present disclosure.
Figure 10:
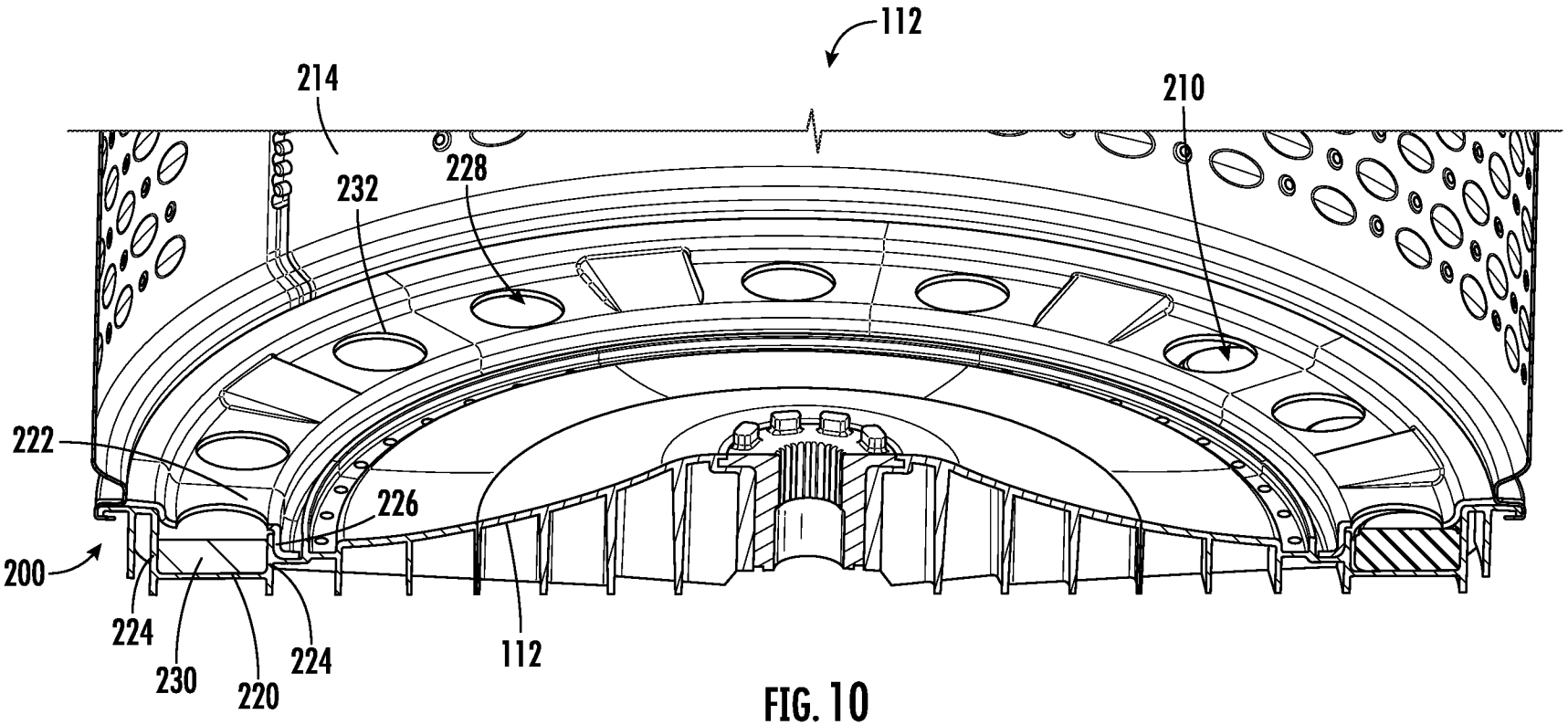
FIG. 10 provides a cut-away perspective view of an exemplary embodiment of a bottom-positioned balance ring assembly for the laundry machine appliance in accordance with aspects of the present disclosure.

In still various embodiments, the top wall 222 forms a cover including one or more sidewalls 226 extending adjacent to one or more sidewalls 224. For instance, sidewalls 224 may extend along the vertical direction from the base wall 220 and sidewalls 226 may extend along the vertical direction from the top wall 222 and adjacent to sidewall 224. In some embodiments, sidewalls 224 may extend downward (e.g., toward the floor or base 212), such as depicted in FIGS. 6-8. In still some embodiments sidewalls 224 may extend upward (e.g., toward the top panel 118). Sidewalls 226 generally extend downward from the top wall 222, such as to position alongside sidewalls 224 along the vertical direction. Sidewalls 224, 226 may be bonded together via any appropriate method, such as further described herein, to seal the passage 218, such as to fluidly segregate the passage 218 from the wash chamber 114.

Figure 4:
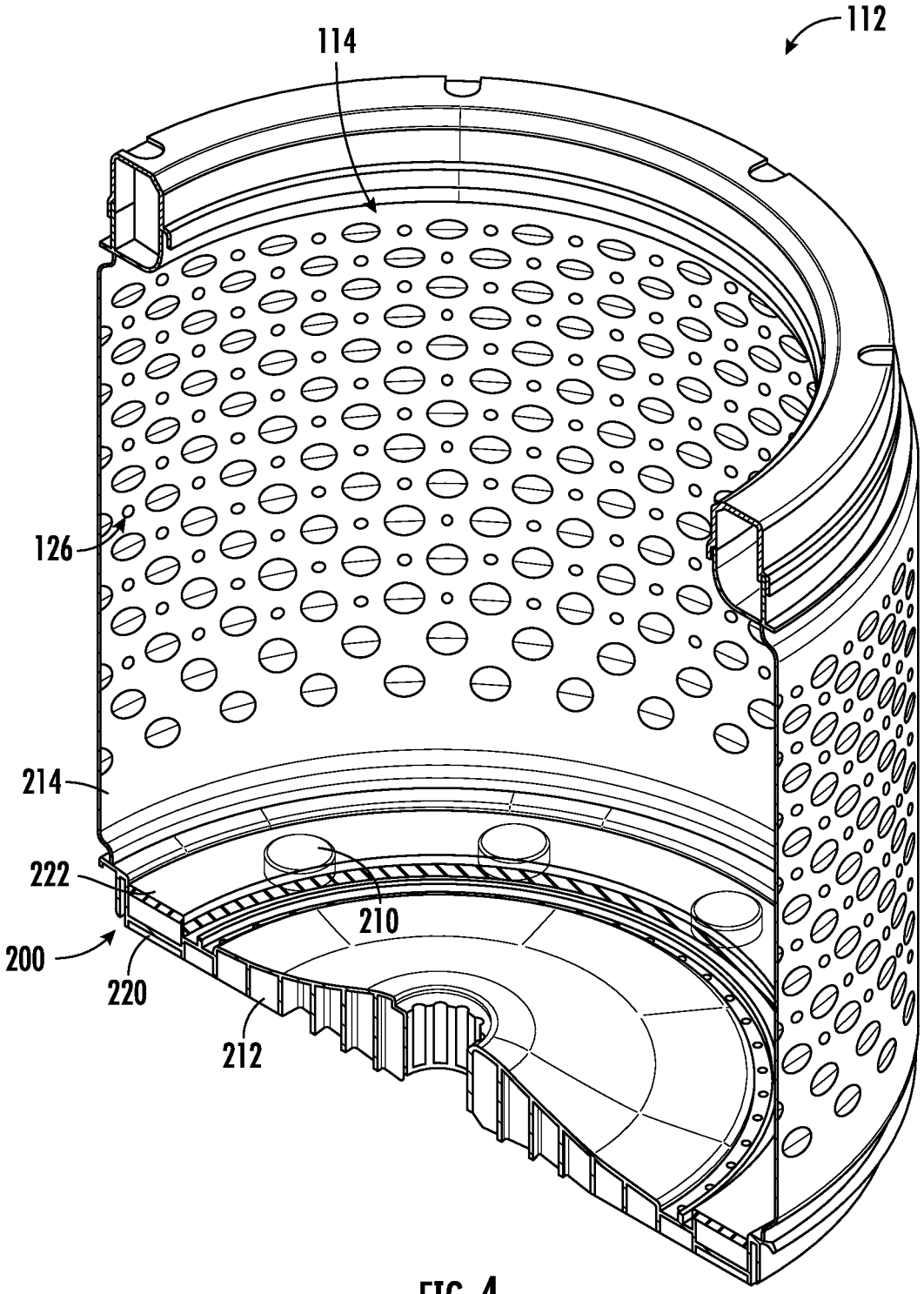
FIG. 4 provides a cut-away perspective view of an exemplary embodiment of a wash basket for the laundry machine appliance in accordance with aspects of the present disclosure.
Figure 5:
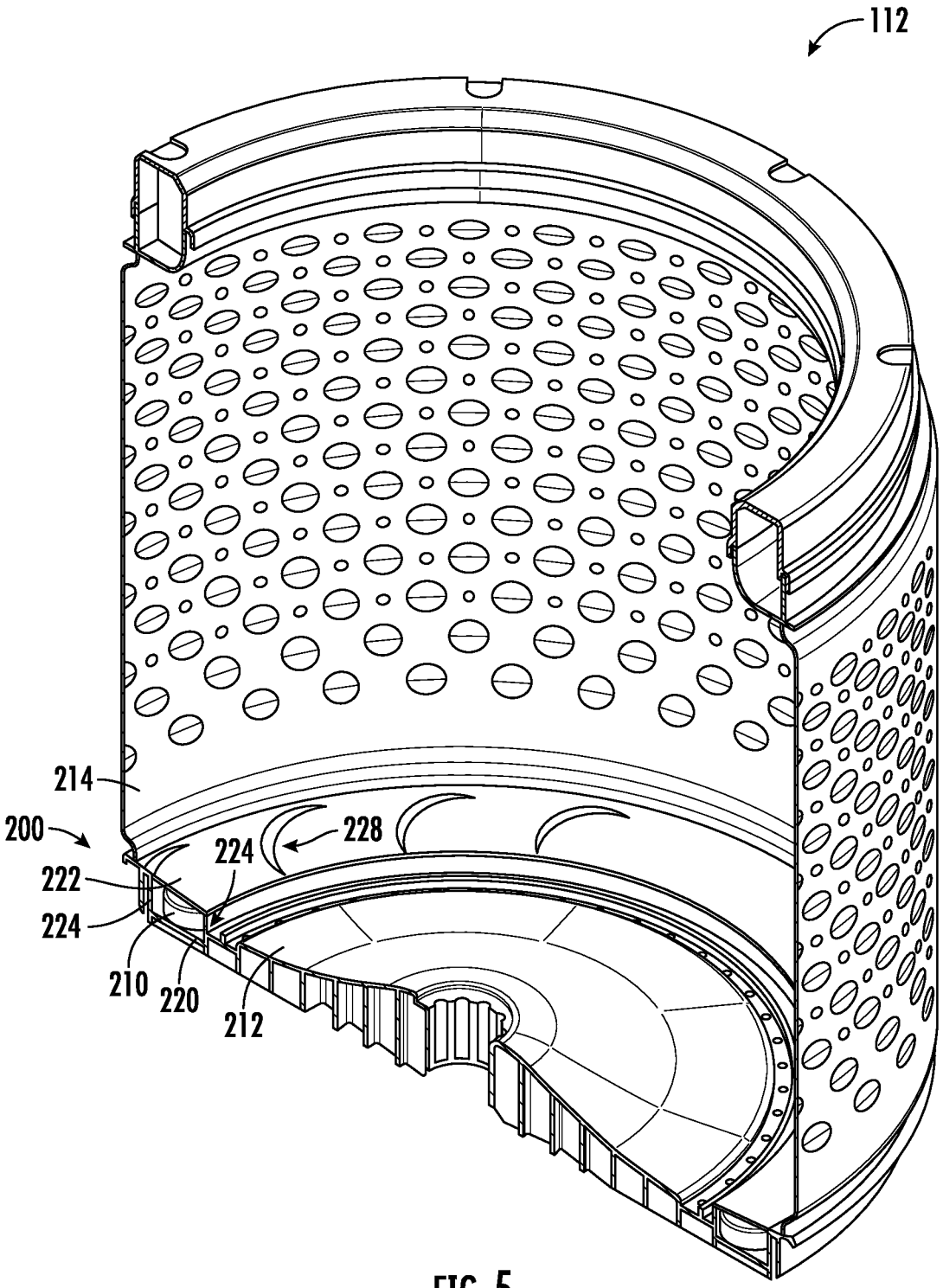
FIG. 5 provides a cut-away perspective view of an exemplary embodiment of a wash basket for the laundry machine appliance in accordance with aspects of the present disclosure.

Balance ring assembly 200 may be formed via overmolding, insert molding, co-injection molding, hot plate molding, plastic welding, or combinations thereof. In some embodiments, the base wall 220 is bonded (e.g., welded, brazed, fused, by any appropriate process) to the base 212 at the wash basket 112. In various instances, top wall 222, or furthermore, sidewall 226, may form an integral structure that is bonded and sealed to base wall 220, or furthermore, sidewall 224. In some embodiments, a transparent wall 228 is formed at the top wall 222, such as to form a window to allow a user to see into passage 218. The transparent wall 228 may be bonded to the top wall 222. The top wall 222 may include an opening 232 at which the transparent wall 228 is positioned. For instance, top wall 222 may include a glass filled polypropylene material providing for increased strength, and the transparent wall 228 may include an unfilled polypropylene material allowing for visual transparency. The transparent wall 228 may be welded (e.g., plastic welding or other appropriate bonding process) to the top wall 222, such as at the opening 232. As such, top wall 222 may provide for desired structural integrity, and transparent wall 228 allows for visualization or aesthetic appearance. However, in some embodiments, top wall 222 is formed substantially of the transparent material, such as depicted in FIG. 4.

Embodiments depicted and described herein may facilitate various embodiments of transparent wall 228 geometry, such as, but not limited to, circles, polygons, ovals, crescents, or ornamental features. For instance, embodiments of the balance ring assembly 200 provided herein may allow for the inclusion of ornamental features that may promote visual appeal and increased value for bottom balance ring assemblies. Accordingly, embodiments of the bottom-positioned balance ring assembly 200 provided herein may include structures and methods allowing for the inclusion of ornamental features while promoting wash basket balance or preventing unbalance.

Figure 11:
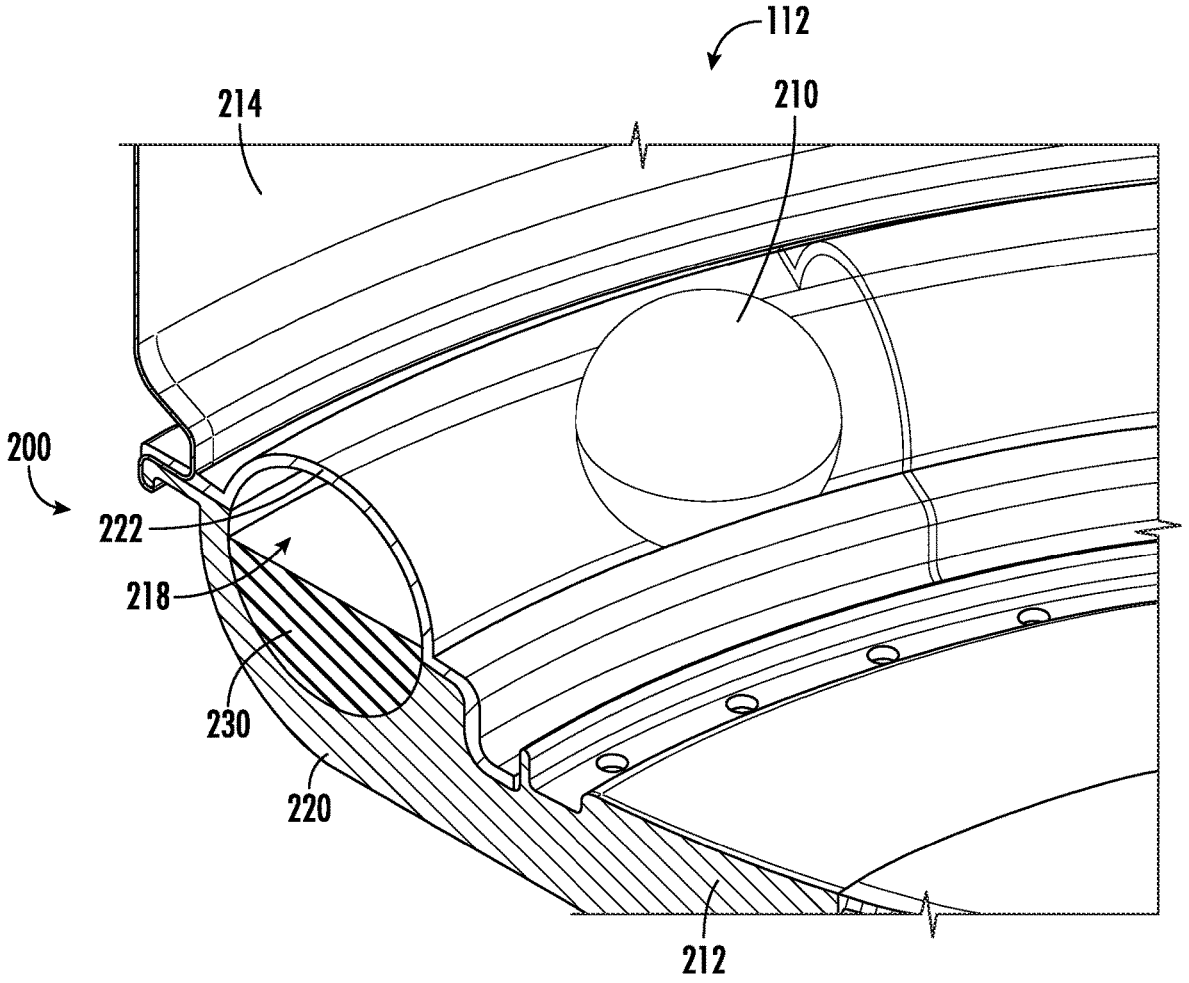
FIG. 11 provides a cut-away perspective view of an exemplary embodiment of a bottom-positioned balance ring assembly for the laundry machine appliance in accordance with aspects of the present disclosure.

Referring to FIG. 11, some embodiments of the balance ring assembly 200 may include the balance member 210 forming a spherical member, such as a ball.

Referring particularly to FIGS. 6-8, in various embodiments, the balance member 210 is a body having a substantially flat face adjacent to the base wall 220, such as a puck. In various embodiments, the balance member 210 forming a puck is configured to roll against the sidewall 226. The balance member 210 may be configured to rotate around a central axis of the puck, and the central axis is allowed to move through the passage 218. For instance, the balance member 210 forming a puck may function as a wheel having its central axis extending through the base wall 220 as the balance member 210 moves through the passage 218. Accordingly, embodiments of the balance member 210 promote greater mass without requiring greater height of the passage. In still some embodiments, the balance member 210 forming a puck may include a diameter to height greater than 1.

In some embodiments, balance member 210 may include a face (e.g., a pair of faces) extending at least partially co-directional to the base wall 220 or the ground. For instance, the face may be flat, concave, or convex, and substantially corresponding to the base wall 220 having a flat, concave, or convex structure. In still some embodiments, the balance member 210 may form a substantially cylindrical structure (e.g., a puck). It should be appreciated that the balance member 210 may include openings or dimples extending thereinto.

The balance member 210 forming a puck may particularly allow for greater mass at or along the face, allowing for a reduced height of the sidewalls 224 in contrast to the balance member forming a spherical member, such as a ball. Additionally, the balance member 210 including the flat face allows for the top wall 222 to form a substantially flat face (e.g., extending co-directional with the base wall 220 or a ground at which the appliance 100 is positioned). The top wall 222 forming a flat face may allow for the sidewalls 224 to extend at a lesser height than sidewalls 224 at a balance ring assembly including spherical balance members.

Additionally, the balance member 210 including a flat face (e.g., a puck) facilitates manufacturing with a variety of materials and geometries. Still further, the balance member 210 including a flat face may facilitate improved manufacturability in contrast to spherical structures. Accordingly, the balance member 210 having a flat face may allow for reducing the cost of the bottom balance ring assembly 200 over bottom balance ring assemblies including spherical-shaped balance members.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry machine appliance, comprising:

a cabinet forming an interior volume;

a tub positioned within the interior volume;

a wash basket rotatably mounted within the tub, the wash basket comprising a cylindrical wall extending from a base positioned at a bottom of the cylindrical wall, the wash basket forming a wash chamber extending along a vertical direction; and a balance ring assembly positioned in the wash chamber at the base of the wash basket, the balance ring assembly forming a sealed passage between a base wall, a sidewall, and a top wall, wherein the top wall comprises a transparent wall permitting a user to see into the sealed passage at which a balance member forming a puck is positioned and permitted to move freely through the sealed passage, the sealed passage extending circumferentially along the wash basket.

2. The laundry machine appliance of claim 1, wherein the balance member forming the puck is configured to rotate against the sidewall.

3. The laundry machine appliance of claim 1, wherein the balance member forming the puck comprises a flat face extending co-directional with the base wall.

4. The laundry machine appliance of claim 1, wherein the balance member forming the puck forms a substantially cylindrical structure.

5. The laundry machine appliance of claim 1, wherein the top wall forms a substantially flat face extending co-directional to the base wall.

6. The laundry machine appliance of claim 1, the sealed passage containing a liquid fluid, wherein the sealed passage fluidly segregates the liquid fluid from the wash chamber.

7. The laundry machine appliance of claim 6, wherein the liquid fluid comprises a colorant.

8. The laundry machine appliance of claim 1, wherein the top wall forms an opening at which the transparent wall is positioned.

9. The laundry machine appliance of claim 8, wherein the top wall comprises a glass filled polypropylene material, and wherein the transparent wall comprises an unfilled polypropylene material.

10. The laundry machine appliance of claim 8, wherein the transparent wall forms a separate component bonded onto the top wall.

11. The laundry machine appliance of claim 1, wherein the top wall comprises a cover sidewall extending along the vertical direction, and wherein the sidewall extends along the vertical direction extending from the base wall, and wherein the sidewall and the cover sidewall are bonded together to fluidly segregate the sealed passage from the wash chamber.

12. The laundry machine appliance of claim 1, wherein the laundry machine appliance is a vertical axis top load washing machine appliance.

13. A top load washing machine appliance, comprising:

a cabinet forming an interior volume;

a tub positioned within the interior volume;

a wash basket rotatably mounted within the tub, the wash basket comprising a cylindrical wall extending from a base positioned at a bottom of the cylindrical wall, the wash basket forming a wash chamber extending along a vertical direction; and a balance ring assembly positioned in the wash chamber at the base of the wash basket, the balance ring assembly forming a sealed passage between a base wall, a sidewall extending along the vertical direction from the base wall, and a top wall comprising a cover wall extending along the vertical direction adjacent to the sidewall, wherein the sidewall extending from the base wall and the cover sidewall extending from the top wall are bonded together to fluidly segregate from the wash chamber a liquid fluid contained in the sealed passage, wherein a transparent wall is positioned at the top wall and permitting a user to see into the sealed passage at which a balance member forming a puck is positioned and permitted to move freely through the sealed passage, the sealed passage extending circumferentially along the wash basket.

14. The top load washing machine appliance of claim 13, wherein the top wall forms an opening at which the transparent wall is positioned and permits the user to see into the sealed passage.

15. The top load washing machine appliance of claim 13, wherein the top wall comprises a glass filled polypropylene material, and wherein the transparent wall comprises an unfilled polypropylene material.

16. The top load washing machine appliance of claim 13, wherein at least a portion of the base wall is formed from the base of the wash basket.

* * * * *